United States Patent [19]

Ishihara et al.

[11] 4,347,297

[45] Aug. 31, 1982

[54] ELECTROPHOTOGRAPHIC METHOD AND ELEMENT

[75] Inventors: Shunichi Ishihara, Kodaira; Nobuo Kitajima, Toride; Yuji Nishigaki, Kawasaki; Nobuko Kitahara, Tokyo, all of Japan

[73] Assignee: Canon Kabushiki Kaisha, Tokyo, Japan

[21] Appl. No.: 204,286

[22] Filed: Nov. 5, 1980

[30] Foreign Application Priority Data

Nov. 5, 1979 [JP] Japan ..... 54/142933

[51] Int. Cl.[3] ..... G03G 13/01; G03G 5/14

[52] U.S. Cl. ..... 430/42; 430/31; 430/46; 430/60; 430/63; 430/66

[58] Field of Search ..... 430/31, 42, 46, 60, 430/63, 66

[56] References Cited

U.S. PATENT DOCUMENTS

| | | | |
|---|---|---|---|
| 2,917,385 | 12/1959 | Byrne | 430/63 |
| 3,005,707 | 10/1961 | Kallmann et al. | 430/63 X |
| 3,226,307 | 12/1965 | Tokumoto | 430/46 X |
| 3,413,117 | 11/1968 | Gaynor | 430/42 X |
| 3,717,460 | 2/1973 | Duck et al. | 430/66 |
| 3,836,363 | 9/1974 | Plutchak | 430/46 |
| 3,941,593 | 3/1976 | Butement | 430/66 X |

*Primary Examiner*—Roland E. Martin, Jr.

*Attorney, Agent, or Firm*—Fitzpatrick, Cella, Harper & Scinto

[57] ABSTRACT

An electrophotographic method for color image formation, wherein use is made of an electrophotographic photosensitive member having a multitude of isolated electrically conductive members for forming image elements, a photoconductive layer, and a multitude of sets of electrodes for determining an electric potential of the isolated electrically conductive members in correspondence to a color image original, each set of electrodes comprising a non-transparent electrode, a transparent electrode, and color filter electrodes, and wherein a voltage is applied across the electrodes followed by development.

6 Claims, 14 Drawing Figures

ELECTROPHOTOGRAPHIC METHOD AND ELEMENT

BACKGROUND OF THE INVENTION

1. Field of the Invention

This invention relates to an electrophotographic method for color image formation. More particularly, it is concerned with an electrophotographic method capable of readily controlling tone of an entire color image, or each tone of a color image by appropriate regulation of an electrode voltage.

2. Description of the Prior Art

Heretofore, it has been a practice for the color image formation using an electrophotographic photosensitive member to expose a color image original for at least three times, the exposure being performed through color filters (generally, red, green and blue filters), and to form a toner image at every three exposures using a toner which is complementary to the color of each filter in accordance with the electrophotographic method. For instance, the photosensitive member is first charged, then an image exposure is done through a red filter, thereafter the exposed image is developed with cyan toner, and the thus developed image is transferred onto an image transfer paper. Subsequently, the exactly same process steps as mentioned above are followed with the red color filter being replaced by a blue or green filter, and the developing agent by magenta or yellow toner for the color image formation. In the case of adding an image forming process using black toner to more improve quality of the color image, there is further added a process step wherein the exposure is effected with a slightly stronger exposure light without use of a color filter to electrostatically adhere the black toner on the surface of the photosensitive member corresponding to the black portion in the original image.

In such color image forming method by the conventional electrophotographic process, it is necessary that the image exposure be done at least three times by changing the color filter with the consequence that the process steps become complicated. Furthermore, in the conventional method, corona charging process is effected during an interval between each of these three times exposures and developments. In this corona charging, however, control of the charge quantity is generally extremely difficult. Accordingly, the tone of the color image is controlled by adjusting the exposure quantity. It is again not so easy generally to control with high precision the color tone of the image by adjustment of the exposure quantity, and still more to independently control each tone of the color image.

In the formation of a polychromatic image including black by the conventional electrophotographic process, there has been adopted a method, wherein a black image is first formed with a black toner and then a color image and a black image are formed with color toners. This image forming sequence can, of course, be the reverse of the abovementioned. In this case, however, there are formed two kinds of black images, the one with the black toner and the other with the color toners exclusive of the black toner, so that, if registration of the images is not precisely done during the image exposure and image transfer steps in these two image formations, there would occur such a possibility that the color toner image identical with the black toner image is present near the black toner image in its unregistered state to render the reproduced image unsightly. In particular, in the case of an office copy of a document, the principal image such as letters, numerals, etc. is mostly in black, and there appear colored images only partially.

Formation of the black image alone from a polychromatic image including black could be done easily with the conventional method (i.e., by exposing the image with light of the same color as the coloring matter, etc.), but it is impossible to form the colored image alone with such conventional method.

SUMMARY OF THE INVENTION

It is therefore a principal object of the present invention to provide an electrophotographic method which facilitates control of an overall tone of a color image to be formed by an electrode voltage and control of an individual color tone.

It is another object of the present invention to provide an electrophotographic photosensitive member and an electrophotographic method, in which no black developer is applied in superposition on color developers other than black when reproducing a polychromatic image original including a black portion.

It is still another object of the present invention to provide an electrophotographic photosensitive member and an electrophotographic method capable of reproducing and developing only those colored portions other than the black portion in the reproduction of a polychromatic image original including the black portion.

According to an aspect of the present invention, there is provided an electrophotographic method which comprises the steps of:

(a) applying a voltage across at least two electrodes in an electrophotographic photosensitive member composed of a multitude of isolated electrically conductive members for image element formation, a photoconductive layer, and a multitude of sets of electrodes, each set of electrodes being composed of a non-transparent electrode, a transparent electrode, and a color filter electrode, to effect the color image exposure from the side of the color filter electrode to thereby produce differences between a region corresponding to those color portions in the image original having wavelength regions not transmitting through the color filter electrode but transmitting through the transparent electrode and each region corresponding to a white portion in the image original where light transmits through both the transparent electrode and the color filter electrode, a region corresponding to a color portion in the image original having a wavelength region which transmits through the color filter electrodes and a region corresponding to a black portion in the image original where no light transmits through the transparent electrode and the color filter electrode with respect to the distributed voltages between the transparent electrode and the isolated electrically conductive member, between the color filter electrode and the isolated electrically conductive member, and between the non-transparent electrode and the isolated electrically conductive member; and (b) causing a developing material to be selectively adhered to the isolated electrically conductive member of the region corresponding to those color portions in the image original having wavelength regions not transmitting through the color filter electrode but transmitting through the transparent electrode, by a difference in the electric potential of said isolated electrically conductive member which occurs in correspondence to the difference in the distributed voltages.

According to another aspect of the present invention, there is provided an electrophotographic method which comprises the steps of:

(a) applying a voltage across at least two electrodes in an electrophotographic photosensitive member composed of a multitude of isolated electrically conductive members for image element formation, a photoconductive layer, a multitude of sets of electrodes, each set of electrodes being composed of a non-transparent electrode, a transparent electrode, and a color filter electrode, to effect the color image exposure from the side of the color filter electrode to thereby produce differences between a region corresponding to those color portions in the image original having wavelength regions not transmitting through the color filter electrodes but transmitting through the transparent electrodes and each of a region corresponding to a white portion in the image original where light transmits through both transparent electrode and the color filter electrode, a region corresponding to a color portion in the image original having a wavelength region which transmits through the color filter electrodes and a region corresponding to a black portion in the image original where no light transmits through the transparent electrode and the color filter electrode with respect to the distributed voltages between the transparent electrode and the isolated electrically conductive member, between the color filter electrode and the isolated electrically conductive member, and between the non-transparent electrode and the isolated electrically conductive member;

(b) causing a developing material to be selectively adhered to the isolated electrically conductive member of the region corresponding to those color portions in the image original having wavelength regions not transmitting through the color filter electrode but transmitting through the transparent electrode, by a difference in the electric potential of said isolated electrically conductive member which occurs in correspondence to the difference in the distributed voltages;

(c) applying a voltage across at least said non-transparent electrode and said transparent electrode to effect the color image exposure from the side of said color filter electrode to cause a difference to occur between a region corresponding to the black portion in the image original where no light transmits through said transparent electrode and a region other than said region with respect to the distributed voltages between the transparent electrode and the isolated electrically conductive member and between the non-transparent electrode and the isolated electrically conductive member; and (d) causing the developing material to be selectively adhered onto the isolated electrically conductive member by a difference in the potential of said isolated electrically conductive members which occurs in correspondence to the difference in the distributed voltages.

According to a further aspect of the present invention, there is provided an electrophotosensitive member comprising:

(a) a multitude of isolated electrically conductive members for image element formation;

(b) a photoconductive layer; and (c) a multitude of sets of electrodes for determining an electrical potential of said isolated electrically conductive member in correspondence to a color image original, each set of electrodes being composed of a non-transparent electrode, a transparent electrode, and color filter electrodes.

BRIEF DESCRIPTION OF THE DRAWING

In the drawing

FIGS. 9 to 12 are respectively process diagrams of the electrophotographic method according to the present invention, wherein FIG. 9 shows the developing step with cyan toner, FIG. 10 the developing step with magenta toner, FIG. 11 the developing step with yellow toner, and FIG. 12 the developing step with black toner.

DETAILED DESCRIPTION OF PREFERRED EMBODIMENTS

In the following, the present invention will be described in detailed with reference to preferred embodiments shown in the accompanying drawing.

The electrophotosensitive member to be used for the present invention is composed of a multitude of isolated electrically conductive members for image element formation, a photoconductive layer, and a multitude of sets of electrodes for determining an electrical potential of the isolated electrically conductive members in correspondence to a color image original, each set of electrodes being composed of a non-transparent electrode, a transparent electrode, and color filter electrodes.

The developing material (or developer) to be used may be arbitrarily selected from ones of various colors depending on user's needs for the image formation. In case a faithful color reproduction of an image original is to be obtained, the color of the developer may be that of a light which is absorbed by a color filter of a color filter electrode.

Figure 1:
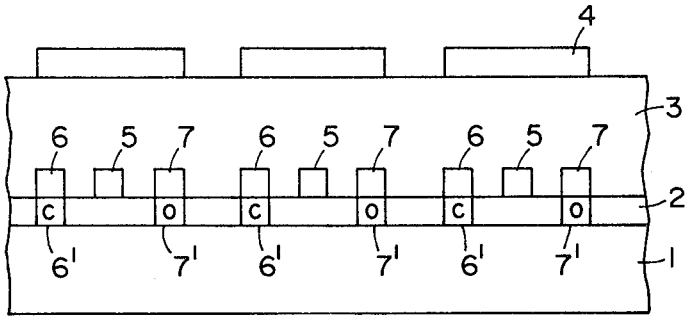
FIGS. 1, 8, 13, and 14 illustrate preferred embodiments of the electrophotosensitive member according to the present invention.

The representative construction of the photosensitive member for use in the present invention is shown in FIG. 1. In the illustration of FIG. 1, a numeral 1 designates a supporting member (or a substrate), a reference numeral 2 designates a filter layer, 3 refers to a photoconductive layer, a numeral 4 an isolated electrically conductive member, 6 a color filter electrode provided with a color filter 6', 5 a transparent electrode, and 7 a non-transparent electrode provided with a non-transparent filter 7'. Arbitrary color filters as selected from red, blue, green, cyan, magenta, yellow, etc. may be used depending on the image to be reproduced.

The substrate 1 is transparent, and made of glass, resin, and like other materials.

The filter layer 2 having the non-transparent filter 7' and the color filter 7' may be produced in the same manner as in the production of a conventional color filter. Representative methods are the "vapor deposition method" and the "coloring method".

The vapor deposition method is to make the color filter with an interference filter, wherein thin films, each having different refractive index, are vapor deposited on the substrate through a mask in a plurality of laminated layers to a predetermined thickness so that only a desired wavelength region of light (color) may be transmitted by the interference effect of the light, thereby forming the color filters in red, green, blue, etc. Incidentally, the non-transparent filter may be formed of metal materials such as Al, Ag, Pb, Ni, Au, etc. or by evaporative deposition or a coating of black dye to be mentioned later.

The dyeing (or coloring) method is to form the filter layer by coating the substrate with a resin material such as polyvinyl alcohol, gelatin, polyurethane, polycarbonate, etc. to provide a dye accepting layer, to which a dyestuff is applied. In order to form each of the non-transparent, red, green, and blue filters, there will be usually performed the process steps of forming a mask on the dye accepting layer using a photoresist, then applying a dyestuff in one color to a predetermined portion, and removing the mask by etching. The process steps are repeated for each filter.

The representative dyestuffs for use in the color filter according to the present invention are as follows.

(1) Acceptable sublimable red dyes: Celliton Scarlet B (supplied by BASF), Diacelliton Fast Pink R (supplied by Mitsubishi Chemical Industrial Ltd.), Terasil Brilliant Pink 4BN (supplied by Ciba-Geigy Ltd.), Kayalon Red R (supplied by Nippon Kayaku Co., Ltd.), Sumikaron Red E-FBL (supplied by Sumitomo Chemical Co., Ltd.), Resolin Red FB (supplied by Bayer AG.), Sumiacryl Rhodamine 6GCP (supplied by Sumitomo Chemical Co., Ltd.), Aizen Cathilon Pink FGH (supplied by Hodogaya Chemical Co., Ltd.), Maxilon Brilliant Red 4G (supplied by Ciba-Geigy Ltd.), Diacryl Supra Brilliant Pink R-N (supplied by Mitsubishi Chemical Industrial Ltd.) and the like.

Acceptable red dyes for application: Suminol Fast Red B conc. (supplied by Sumitomo Chemical Co., Ltd.), Aizen Brilliant Scralet 3 RH (supplied by Hodogaya Chemical Co., Ltd.), Azo Rubinol 3GS 250% (supplied by Mitsubishi Chemical Industrial Ltd.), Kayaku Acid Rhodamine FB (supplied by Nippon Kayaku Co., Ltd.), Acid Anthracene Red 3B (supplied by Chuhgai Chemical Co., Ltd.), Benzil Fast Red B (supplied by Ciba-Geigy Ltd.), Palatine Fast Red RN (supplied by BASF), Nylomine Red 2BS (supplied by I.C.I. Ltd.), Lanafast Red 2GL (supplied by Mitsui-Toatsu Chemicals Inc.), Rose Bengal (supplied by Kii Chemical Industry Ltd.) and the like.

(2) Acceptable sublimable green dyes: Aizen Diamond Green GH (supplied by Hodogaya Chemical Co., Ltd.), Aizen Malachite Green (supplied by Hodogaya Chemical Co., Ltd.), Brilliant Green (supplied by E.I. du Pont de Nemours & Co., Inc.), Fast Green JJO (supplied by Ciba-Geigy Ltd.), Synacril Green G (supplied by I.C.I. Ltd.), Victoria Green (supplied by E.I. du Pont de Nemours & Co., Inc.) and the like.

Acceptable green dyes for application: Kayakalan Blue-Black 3BL (supplied by Nippon Kayaku Co., Ltd.), Sumilan Green BL (supplied by Sumitomo Chemical Co., Ltd.), Aizen Floslan Olive Green GLH (supplied by Hodogaya Chemical Co., Ltd.), Diacid Cyanine Green GWA (supplied by Mitsubishi Chemical Industrial Ltd.), Cibalan Green GL (supplied by Ciba-Geigy Ltd.), Carbolan Brilliant Green 5G (supplied by I.C.I. Ltd.), Palatine Fast Green BLN (supplied by BASF), Acid Green GBH (supplied by Takaoka Chemical Co., Ltd.), Acid Brilliant Milling Green B (supplied by Mitsui-Toatsu Chemicals Inc.) and the like.

Also, green can be produced by incorporation of blue-and yellow-dyes.

(3) Acceptable sublimable blue dyes: Miketon Fast Blue Extra (supplied by Mitsui-Toatsu Chemicals Inc.), Kayalon Fast Blue FN (supplied by Nippon Kayaku Co., Ltd.), Sumikaron Blue E-BR (supplied by Sumitomo Chemical Co., Ltd.), Terasil Blue 2R (supplied by Ciba-Geigy Ltd.), Palanil Blue R (supplied by BASF), Aizen Brilliant Basic Cyanine 6GH (supplied by Hodogaya Chemical Co., Ltd.), Aizen Cathilon Blue GLH (supplied by Hodogaya Chemical Co., Ltd.), Cibacet Blue F3R (supplied by Ciba-Geigy Ltd.), Diacelliton Fast Brilliant Blue B (supplied by Mitsubishi Chemical Industrial Co., Ltd.), Dispersol Blue BN (supplied by I.C.I. Ltd.), Resolin Blue FBL (supplied by Bayer A.G.), Latyl Blue FRN (supplied by E.I. du Pont de Nemours & Co., Inc.), Sevron Blue ER (supplied by E.I. du Pont de Nemours & Co., Ltd.), Diacryl Brilliant Blue H2R-N (supplied by Mitsubishi Chemical Industrial Co., Ltd.) and the like.

Acceptable blue dyes for application: Orient Soluble Blue OBC (supplied by Orient Chemical Co., Ltd.), Suminol Leveling Blue 4GL (supplied by Sumitomo Chemical Co., Ltd.), Kayanol Blue N2G (supplied by Nippon Kayaku Co., Ltd.), Mitsui Alizarine Saphirol B (supplied by Mitsui-Toatsu Chemicals Inc), Xylene Fast Blue BL 200% (supplied by Mitsubishi Chemical Industrial Co., Ltd.), Alizarine Fast Blue R (supplied by Ciba-Geigy Ltd.), Carbolan Brilliant Blue 2R (supplied by I.C.I. Ltd.), Palatine Fast Blue GGN (supplied by BASF), Aizen Opal Blue New conc. (supplied by Hodogaya Chemical Co., Ltd.), Fastogen Blue SBL (supplied by Dinihon Ink Chemical Co., Ltd.) and the like.

Acceptable blank dyes: Suminol Fast Black BR conc. (supplied by Sumitomo Chemical Co., Ltd.), Diacelliton Fast Black T (supplied by Mitsubishi Chemical Industrial Ltd.), Miketazol Black 3GF (supplied by Mitsui-Toatsu Chemicals Inc.), Kayalon Diazo Black 2GF (supplied by Nippon Kayaku Co., Ltd.), and Aizen Opal Black WGH (supplied by Hodogaya Chemical Co., Ltd.) and the like.

The above-mentioned names are all trade names.

The cyan, magenta and yellow dyes may be optionally selected for use from commercially available ones.

Transparent electrodes 5 are formed by the following step. On the filter layer are deposited by vacuum evaporation materials for transparent electrodes, for example, $In_2O_3$, $SnO_2$, In—Sn—O etc., or metals such as Au, Cu and the like in a thin film state. Thereafter, a comb shape of masking pattern is formed by using photoresists, then the layer of $In_2O_3$ etc. is selectively removed by using the predetermined etching agents such acids or alkalis, and the masking pattern of the photoresists is removed to form a transparent electrode. Electrodes 6 and 7, as well as those 13–17 mentioned later are also formed in a similar way to above.

Materials which are already generally used for photoresist can be used as photoresist for forming the color filters and electrodes. For example, the following are commercially available: KPR (trade name, Kodak Photo Resist; supplied by Kodak . . . developer: methylene chloride, trichlene etc.), KMER (trade name, Kodak Metal Etch Resist; supplied by Kodak . . . developer: Xylene, trichlene etc.), TPR (trade name; supplied by Tokyo Ohka . . . developer: Xylene, trichlene etc.), Shipley AZ 1300 (trade name; supplied by Shipley . . . developer: alkali aqueous solution), KTFR (trade name, Kodak Thin Film Resist; supplied by Kodak . . . developer: Xylene, trichlene etc.), FNRR (trade name; supplied by Fuji Yakuhin Kogyo Co., Ltd. . . . developer: Chlorcene), FPER (trade name, Fuji Photo Etching Resist; supplied by Fuji Photo Film Co., Ltd. . . . developer: trichlene), TESH DOOL (trade name; supplied by Okamoto Chemical Industrial Co., Ltd. . . . developer: water), Fuji-Resist No. 7 (trade name; supplied by Fuji Yakuhin Kogyo Co., Ltd. . . . developer: water); and the like. Further, there are used trichlene, methylene chloride, AZ Remover (trade name; supplied by Shipley), sulfuric acid and the like for removing the used mask.

Figure 2:
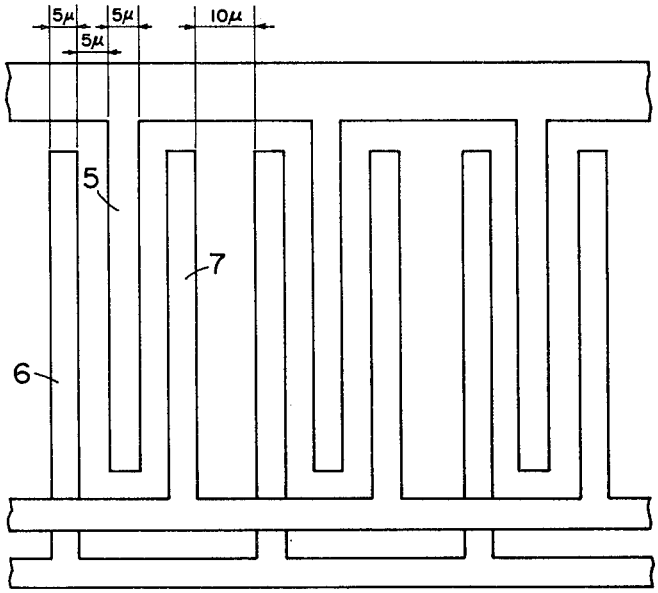
FIG. 2 is a plan view of an electrode pattern in the electrophotosensitive member shown in FIG. 1.

Formation of each electrode may be done by vapor-deposition of an electrode forming material on the substrate through a mask having therein a comb-shaped opening, followed by removal of the mask. Thickness of the electrode usually ranges from 500 Å to 6,000 Å. The electrode formed on a portion where no color filter has been formed acts as the transparent electrodes 5 (FIGS. 1 and 5) and 13 (FIGS. 8 through 14), the electrode formed on the non-transparent filter 7' (or 15') acts as the non-transparent electrode 7 (or 15), and the electrode formed on each color filter acts as an individual color filter electrode. FIG. 2 is a plan view showing the comb-shaped color filter electrode thus formed in the photosensitive member shown in FIG. 1, in which a portion where the non-transparent electrode 7 and the color filter electrode 6, each being in a juxtaposed relationship with the transparent electrode 5, overlap in their up-and-down position, is electrically insulated by, for example, interposing an insulative paint therebetween.

The photoconductive layer 3 is formed by the vacuum deposition of an inorganic photoconductive material such as S, Se, PbO, or alloys and intermetallic compounds containing therein S, Se, Te, As, Sb, etc. When the sputtering method is used, a photoconductive substance of high melting point such as ZnO, CdS, CdSe, $TiO_2$, and so on may be deposited on the substrate to form the photoconductive layer. In the case of forming the photoconductive layer by coating, there may be used various organic photoconductive materials such as polyvinyl carbazol, anthracene, phthalocyanine, and so forth, or such organic photoconductive materials which have been color-sensitized or Louis acid-sensitized, for a mixture of such organic photoconductive materials and an insulative binder. A mixture of inorganic photoconductive material such as ZnO, CdS, $TiO_2$, PbO, etc. and an insulative binder is also suited for the purpose. For the insulative binder, there may be used various sorts of resins. The thickness of the photoconductive layer, though it depends on the kind and characteristics of the photoconductive material to be used, may generally range from 5 to 100 microns, or more preferably from 10 to 50 microns or so.

Figure 3:
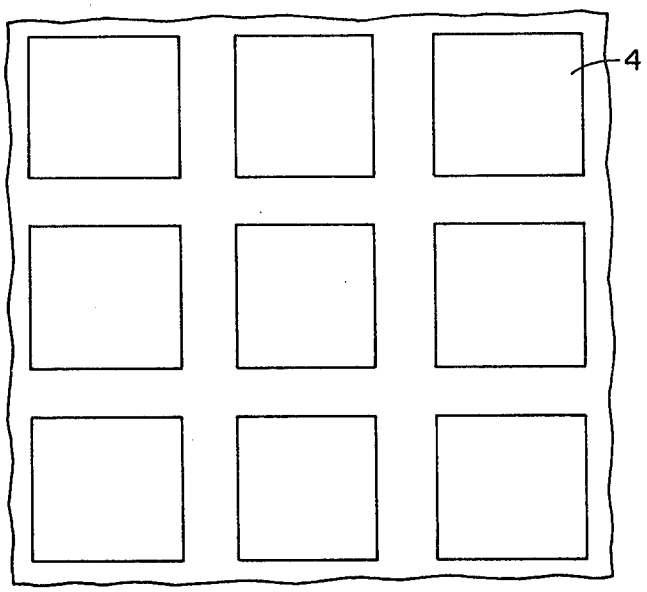
FIG. 3 is a plan view of the isolated electrically conductive members of the electrophotosensitive member shown in FIG. 1.

The isolated electrically conductive members 4 are discrete insular bodies of an electrically conductive substance, which are important to constitute elements of an image. Each of the isolated electrically conductive members is in the square form as shown in FIG. 3. Formation of the isolated electrically conductive members can be done in exactly the same manner as in the case of the color filter electrodes.

As a representative method of forming the color image using the photosensitive member according to the present invention, the following explanations will be given as to a case of using an original image having red, black and white portions therein. The photosensitive member to be used is of the same construction as that shown in FIG. 1, and the cyan filter is used as the color filter.

First of all, voltages $V_1$ and $V_2$ are respectively applied across the electrodes 5 and 6, and the electrodes 5 and 7, the electrode 7 being earthed. In this state, the image original is irradiated, whereupon a potential $V_0$ is generated in the isolated electrically conductive members 4.

Figure 4:
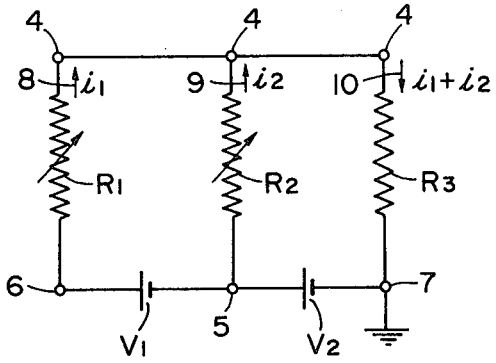
FIG. 4 shows an equivalent circuit when voltages are applied to the electrodes for image formation using the photosensitive member shown in FIG. 1.

In the following, this potential $V_0$ will be explained in reference to a model equivalent circuit as shown in FIG. 4 which is maintained in the above-described state.

In the drawing, an electric current $i_1$ flows in an arrow direction 8, an electric current $i_2$ in an arrow direction 9, and an electric current $i_1+i_2$ in an arrow direction 10. Here $R_1$ represents a resistor between the electrode 6 and the isolated electrically conductive member 4; $R_2$ designates a resistor between the electrode 5 and the isolated electrically conductive member 4; and $R_3$ refers to a resistor between the electrode 7 and the isolated electrically conductive member 4. It is further assumed that $R_1$ changes from $R_{1D}$ to $R_{1L}$ when irradiating white light; $R_2$ changes from $R_{2D}$ to $R_{2L}$ when irradiating white and red lights; and $R_3$ is constantly $R_{3D}$.

Now, for the sake of simplicity in the explanation, if it is assumed that the structure, area, etc. of the electrodes 6, 5 and 7 are made uniform, the following relationship can be established.

$$R_{1D}=R_{2D}=R_{3D}$$

Further, if the photoconductive characteristic of the photoconductive layer is of such a degree that is usually used in the electrophotography, $R_{1D}/R_{1L}$ and $R_{2D}/R_{2L}$ can be taken as being $10^3$ and above when a white light of sufficient intensity is irradiated, while $R_{2D}/R_{2L}$ can be taken as being $10^3$ and above when a red light of sufficient intensity is irradiated. It is also possible that the following relationship can be established from the electrode structure.

$$R_{1L}=R_{2L}$$

When the current flows are determined as in FIG. 4, the following circuit equation is established from the Kirchhoff's Law.

$$\begin{cases} -R_1 i_1 + R_2 i_2 + V_1 = 0 & (1) \\ -R_2 i_2 - R_3(i_1 + i_2) + V_2 = 0 & (2) \\ V_0 = R_3(i_1 + i_2) & (3) \end{cases}$$

From (1) and (2), the values of $i_1$ and $i_2$ are found, which are then substituted into (3), the following can be derived.

$$V_0 = V_2 - R_2 \frac{V_2 - R_3/R_1 \cdot V_1}{R_2 + R_3 + \frac{R_2R_3}{R_1}}$$

When the above equation is rearranged, it can be denoted as follows.

$$V_0 = \frac{R_3/R_2 \cdot V_2 + R_3/R_1(V_1 + V_2)}{(1 + R_3/R_2 + R_3/R_1)} \quad \text{(A)}$$

When a black light is irradiated, a portion corresponding to the black portion in the image original is in a relationship of $R_1=R_2=R_3=R_D$, and the potential $V_0$ of the isolated electrically conductive member corresponding to the black portion in the image original becomes as follows.

$$V_0=\tfrac{1}{3}V_1+\tfrac{2}{3}V_2 \quad \text{(a)}$$

Also, when a white light is irradiated, a portion corresponding to the white portion in the image original is in a relationship of $R_3=R_D>>R_1=R_2=R_L$ and $R_3/R_2=R_3/R_1>10^3$, hence the potential $V_0$ of the isolated electrically conductive member corresponding to the white portion in the image original becomes as follows.

$$V_0 = \frac{2\,R_3/R_1 \cdot V_2 + R_3/R_1 \cdot V_1}{1 + 2(R_3/R_1)} \quad \text{(b)}$$

$$V_0 = \tfrac{1}{2}V_1 + V_2$$

Further, when a red light is irradiated, a portion corresponding to the red portion in the image original is in a relationship of $R_3=R_1=R_D>R_2=R_L$, and the potential $V_0$ of the isolated electrically conductive member corresponding to the red portion in the image original is represented as follows.

$$V_0 = \frac{R_3/R_2\,V_2 + (V_2 + V_1)}{2 + R_3/R_2} \simeq \frac{R_3/R_2\,V_2}{R_3/R_2} \quad \text{(c)}$$

$$V_0 \simeq V_2$$

Now, assume that, in the above equations (a), (b) and (c), $V_2 \simeq 0$. The potential $V_0$ at the black portion becomes $V_0=\frac{1}{3}V_1$; at the white portion, $V_0=\frac{1}{2}V_1$; and, at the red portion, $V_0=0$.

Further assume that the voltage $V_1$ applied across the electrodes 5 and 6 is $V_1=600$ V, it is 200 V at the black portion, 300 V at the white portion, and zero V at the red portion, so that, when the development is done with the toner of the same polarity as that of $V_1$, the red toner adheres onto the red portion alone. Incidentally, when an image which is not faithful in its color to the image original is to be obtained, there may be used any other arbitrary color toner than red.

When the voltage $V_2$ applied across the electrodes 5 and 7 is $V_2=-\frac{1}{2}V_1$, the potential at the black portion (the equation (a)) is $V_0=0$; the potential at the white portion (the equation (b)) is $V_0=0$; and the potential at the red portion (the equation (c)) is $$V_0 = \frac{V_1}{R_3/R_2} - \frac{V_1}{2} \simeq \frac{-V_1}{2}.$$

In this case, when $V_1=600$ V and $V_2=-300$ V, for example, the black portion is at zero V, the white portion is at zero V, and the red portion is at $-300$ V, hence there is no potential difference between the black and white portions.

In the equivalent circuit in FIG. 4, the condition for the contrast between the black portion and the white portion to be smaller than that between the red portion and the white portion is as follows.

$$|V_1+2V_2|<|3V_1|$$

Unless the above condition is satisfied, the image containing the red portion alone becomes unobtainable.

Further, a condition for the potential contrast between the black portion and the white portion to be limited to 50% or below of the potential contrast between the red portion and the white portion is as follows.

$$2|V_1+2V_2| \leqq |3V_1|$$

The above condition is considered more preferable. Incidentally, it is also possible, by application of a voltage across the electrodes 6 and 7 as well as 5 and 7, to obtain the same results as those wherein the voltage $V_1$ is applied across the electrodes 6 and 5, and the voltage $V_2$ is applied across the electrodes 5 and 7, as shown in FIG. 4.

Figure 5:
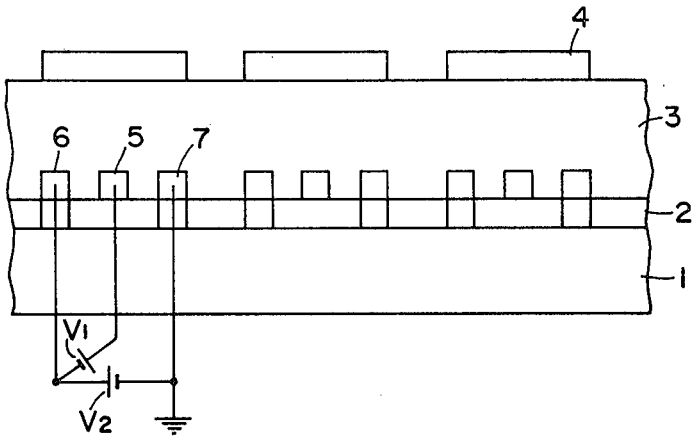
FIG. 5 illustrates another embodiment of the voltage application to the electrodes for image formation using the photosensitive member shown in FIG. 1.

If the voltage is applied in the manner as shown in FIG. 5, the equivalent circuit can also be represented as in FIG. 4, although $R_1$ designates a resistor between the electrode 5 and the isolated electrically conductive member 4 and $R_2$ denotes a resistor between the electrode 6 and the isolated electrically conductive member 4. Accordingly, $R_1$ changes from $R_{1D}$ to $R_{1L}$ when irradiating the white and red lights, and $R_2$ changes from $R_{2D}$ to $R_{2L}$ when irradiating the white light. If it is assumed that the other conditions are the same as the previous ones, the potential $V_0$ of the isolated electrically conductive member 4 can be given in the foregoing equation (A).

Furthermore, when the black light is irradiated, a portion corresponding to the black portion in the image original is in a relationship of $R_1=R_2=R_3=R_D$, and the potential $V_0$ of the isolated electrically conductive member corresponding to the black portion in the image original is represented as follows.

$$V_0=\tfrac{1}{3}\,V_1+\tfrac{2}{3}\,V_2 \quad \text{(d)}$$

Also, when the white light is irradiated, a portion corresponding to the white portion in the image original is in a relationship of $R_3=R_D>>R_1=R_2=R_L$, and the potential $V_0$ of the isolated electrically conductive member corresponding to the white portion in the image original is represented as follows.

$$V_0=\tfrac{1}{2}\,V_1+V_2 \quad \text{(e)}$$

When the red light is irradiated, a portion corresponding to the red portion in the image original is in a relationship of $R_3=R_2=R_D>>R_1=R_L$, and the potential $V_0$ of the isolated electrically conductive member corresponding to the red portion in the image original is represented as follows.

$$V_0 = \frac{V_2 + R_3/R_1(V_1 + V_2)}{2 + R_3/R_1} \quad \text{(f)}$$

hence: $V_0 = V_1 + V_2$

Moreover, if $V_2 \approx 0$ as in the previous case, the potential $V_0$ at the black, white, and red portions becomes respectively as follows.

$V_0 = \frac{1}{3} V_1$ at the black portion p1 $V_0 = \frac{1}{2} V_1$ at the white portion $V_0 = V_1$ at the red portion Now, assume that $V_1 = 600$ V. The black portion is at 200 V, the white portion is at 300 V, and the red portion is at 600 V. Therefore, when the development is done with the toner of a different polarity from that of $V_1$, the toner adheres onto the red portion alone. In this case, in order not to cause the toner to adhere onto the other electrodes, it is desirable that a voltage of +300 V and above be applied to the development electrode. Otherwise, when the voltage $V_2$ is so selected as to satisfy the relationship of $V_2 = -V_1/2$, the different between the black and white portions can be eliminated, whereby the red toner can be prevented from adhering onto the black or white portion due to the edging effect, etc.

For example, if $V_1 = 600$ V and $V_2 = -300$ V, the potential $V_0$ at the black, white, and red portions becomes respectively as follows:

$V_0$=zero V at the black portion $V_0$=zero V at the white portion $V_0$=300 V at the red portion, whereby the potential difference becomes non-existent between the black and white portions. Incidentally, it should be noted that, unless the voltages $V_2$ and $V_1$ satisfies the relationship of $|V_1 + 2\ V_2| < |3\ V_1|$, the contrast between the red and white portions becomes smaller than the difference in contrast between the black and white portions, whereby an image in red color alone cannot be obtained.

A condition for the potential contrast between the black and white portions to be limited to 50% or below of the potential contrast between the red portion and the white portion is as follows.

$$2|V_1 + 2\ V_2| \leqq |3\ V_1|$$

In the case of forming a color image including black after the abovementioned process, it is sufficient that the red toner be transferred onto paper, etc. from the photosensitive member, and then the image in black alone be formed on the photosensitive member. At this instant, the electrode 6 may be removed from the image forming circuit by grounding the voltage $V_1$ or maintaining the electrodes 6 and 5 in an open state. Each of these cases is shown in FIGS. 6 and 7 respectively.

Figure 6:
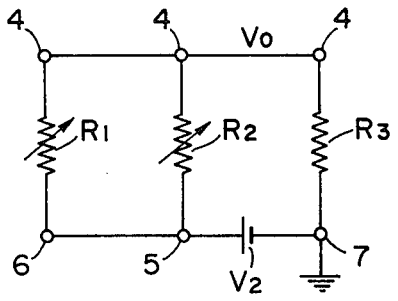
FIGS. 6 and 7 illustrate other embodiments of the equivalent circuit for applying a voltage across the electrodes to form an image using the photosensitive member shown in FIG. 1.

In FIG. 6, when the black portion in the image original is irradiated, it is in a relationship of $R_1 = R_2 = R_3 = R_D$, and the potential $V_0$ of the isolated electrically conductive member 4 becomes $V_0 = \frac{2}{3} V_2$; when the white portion is irradiated, it is in a relationship of $R_3 = R_D >> R_1 = R_2 = R_L$, and the potential $V_0$ becomes $V_0 = V_2$; and when the red portion is irradiated, it is in a relationship of $R_3 = R_1 = R_D > R_2 = R_L$ and the potential becomes $V_0 = V_2$.

Now, assume that $V_2 = 600$ V. Then, at the black portion, the voltage is 400 V, at the white portion, it is 600 V, and at the red portion, it is 600 V. Accordingly, when the development electrode is biassed to 500 V or so with the black positive toner, it is possible to cause the toner to adhere onto the black portion alone. By transfer of this toner onto the above-mentioned paper, onto which the red toner has already been transferred, there can be obtained a colored image in black and red faithful to the original image.

Figure 7:
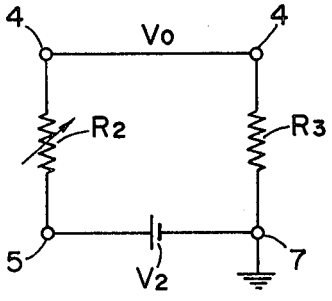

In the equivalent circuit shown in FIG. 7, the black portion of the image is in a relationship of $R_2 = R_3 = R_D$, and the potential $V_0$ of the isolated electrically conductive member 4 becomes $V_0 = \frac{1}{2} V_2$ while the white and red portions are in a relationship of $R_3 = R_D >> R_2 = R_L$, and the potential becomes $V_0 = V_2$.

When $V_2 = 600$ V, the voltage at the black portion is 300 V and that at the white portion is 600 V.

Incidentally, in the above-mentioned example, when the position of the earth is taken at the side of the transparent electrode 5, the potential at the black portion of the image becomes $V_0 = \frac{1}{2} V_2$; and, at the white and red portions, it becomes $V_0 = 0$, hence the relationship between the potentials does not change, although the absolute values thereof differ.

The foregoing explanations are with respect to a case wherein the red portion is included in the image original. It should however be noted that the image formation from an image original containing therein other color portions than red can also be done in exactly the same way as mentioned in the foregoing. For instance, when a green portion is included in the image original, there may be used a magenta filter electrode as the color filter electrode, which is complementary to green, with respect to the photosensitive member shown in FIG. 1, and, when a blue portion is included in the image original, there may be used a yellow filter electrode.

The sequence of the developing process is completely arbitrary, i.e., it may be started from the color portions of the image original or from the other portions thereof. Transfer of the toner adhered onto the photosensitive member may either be done at every process step, or all of the toners adhered onto the photosensitive member be transferred at once after completion of all the preceding process steps.

As is apparent from the foregoing explanations, it is also possible that a particular color portion in the image original (e.g., red portion) or two or more color portions (e.g., red and green portions, or red and black portions) may be selected for the toner image formation.

As has been explained concretely with the photosensitive member in FIG. 1 taken as an example, the color image forming method according to the present invention can readily control the tone of a color image by controlling a voltage value to be applied to the electrode of the photosensitive member. When the full color image is to be formed, using the black toner, the image can be formed without superimposing the other color toners over the black toner, hence registration of each toner image becomes very easy for the purpose of the image transfer.

The photosensitive member and the electrophotographic method according to the present invention can take various other constructions and process steps as shown and described in reference to FIG. 1 above. In the following, representative examples of such other modes of embodiment will be explained.

Figure 8:
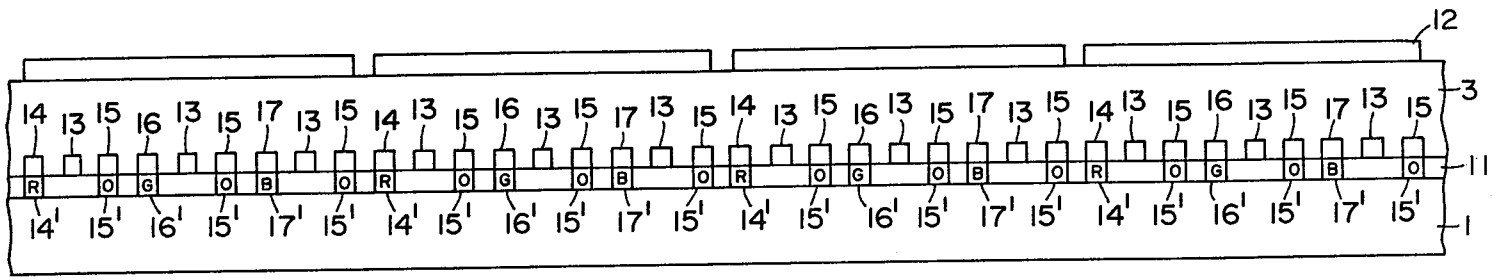

FIG. 8 shows another embodiment of the photosensitive member according to the present invention, wherein the isolated electrically conductive member has a relatively large space area so as to cover three sets of electrodes, i.e., the red filter electrode 14 provided with the red filter 14', the transparent electrode 13, the non-transparent electrode 15 provided with the non-transparent filter 15'; the green filter electrode 16 provided with the green filter 16', the transparent electrode 13, the non-transparent electrode 15; and the blue filter electrode 17 provided with the blue filter 17', the transparent electrode 13, the non-transparent electrode 15. A reference numeral 11 designates a filter layer.

In case a color image is formed using this photosensitive member, since every set of electrodes have an isolated electrically conductive member in common, the toners of more than two colors can be adhered to a single isolated electrically conductive member in a mixed state, hence reproduction of the color image becomes more preferable. The image forming process using this photosensitive member is shown in FIGS. 9 through 12.

STEP 1 (DEVELOPMENT OF CYAN COLOR)

Figure 9:
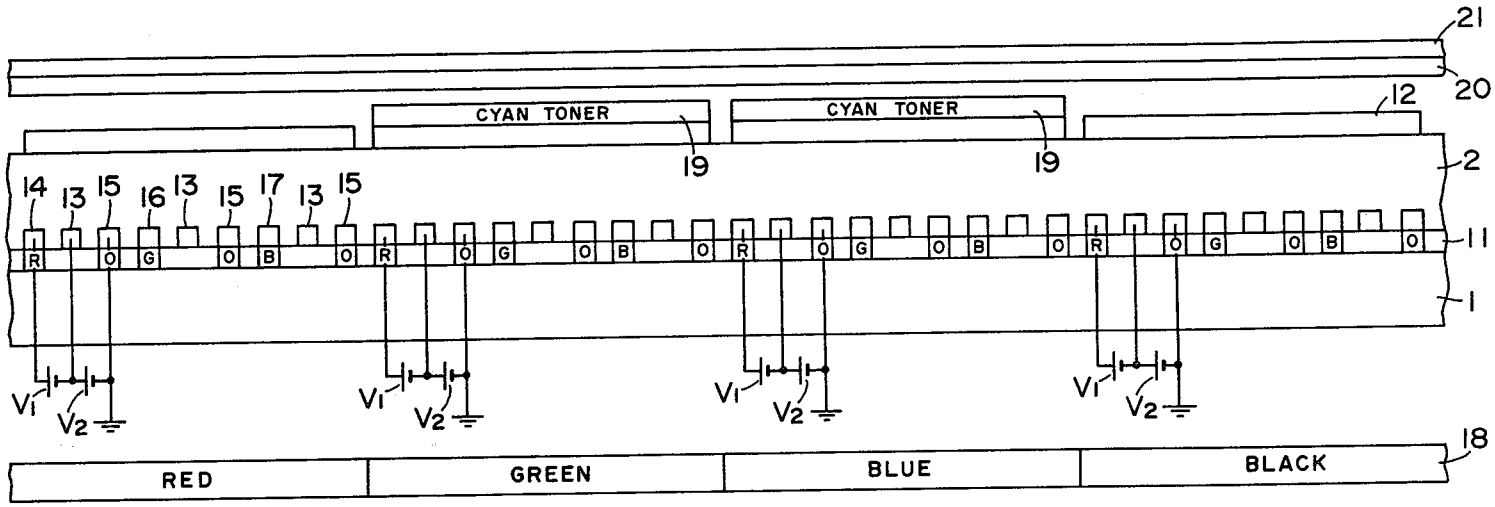

As shown in FIG. 9, voltages $V_1$ and $V_2$ are applied across the electrodes 13 and 14, and across 13 and 15. The relationship between the voltages $V_1$ and $V_2$ is assumed to be $V_2=\frac{1}{2}V_1$, the electrode 15 being grounded. The voltage levels of $V_1$ and $V_2$ are, for example, $V_1=600$ V and $V_2=-300$ V.

In this case, the potential $V_0$ of the isolated electrically conductive member over those portions of the photosensitive member, to which lights from the white (not being shown) and red portions in the image original 18 have been irradiated, becomes zero V. On the other hand, the potential $V_0$ of the isolated electrically conductive member over those portions of the photosensitive member, where lights from the green and blue portions in the image original have been irradiated, becomes $V_0=-\frac{1}{2}V_1$, i.e., $-300$ V. Further, the potential $V_0$ of the isolated electrically conductive member over the portion of the photosensitive member corresponding to the black portion in the image original, where no light has been irradiated, becomes $V_0=$zero V.

Accordingly, in this state, when the development is effected with the cyan toner of the same polarity as that of the voltage $V_1$, i.e., having the positive charge, the cyan toner 19 adheres only on the isolated electrically conductive member of the photosensitive member where lights from the blue and green portions in the image original have been irradiated. This cyan toner 19 can be transferred onto an image transfer paper by bringing paper 20 with a metal plate 21 being placed on its back surface closer to the photosensitive member in this state, and applying an electric field across the metal plate 21 and the photosensitive member.

STEP 2 (DEVELOPMENT OF MAGENTA COLOR)

Figure 10:
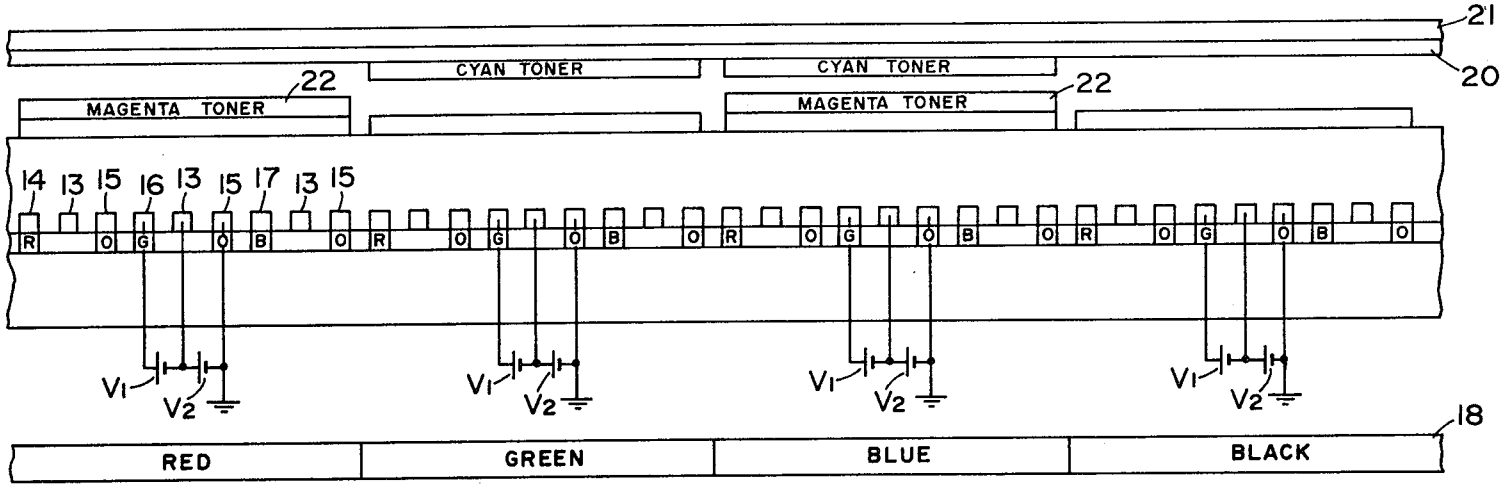

As shown in FIG. 10, the voltages $V_1$ and $V_2$ are applied across the electrodes 13 and 16, and across 13 and 15 with the electrode 15 being grounded. The level and polarity of the voltages $V_1$ and $V_2$ may be either the same as, or different from, those in the Step 1 above. Relationship between the voltages $V_1$ and $V_2$ is now assumed to be $V_2=-\frac{1}{2}V_1$, and their voltage levels are respectively set at $V_1=600$ V and $V_2=-300$ V, for example.

In this case, the potential $V_0$ of the isolated electrically conductive member over those portions of the photosensitive member where lights from the white and green portions in the image original have been irradiated becomes zero V. On the other hand, the potential $V_0$ of the isolated electrically conductive member over those portions of the photosensitive member where lights from the blue and red portions in the image original have been irradiated, becomes $V_0=V_1/2$, i.e., $-300$ V. Furthermore, the potential $V_0$ at the portion thereof corresponding to the black portion in the image original, where no light has been irradiated, becomes $V_0=$zero volt.

Accordingly, in this state, when the development is effected with the magenta color toner of the same polarity as that of the voltage $V_1$, i.e., having the positive charge, the magenta toner 22 adheres only on the isolated electrically conductive member of the photosensitive member where lights from the blue and red portions in the image original have been irradiated. This magenta toner can be transferred onto an image transfer paper by bringing the paper, on which the cyan toner has been adhered in the Step 1 above closer to the photosensitive member in the abovementioned state, and then applying an electric field across the photosensitive member and a metal plate placed on the back surface of the paper.

STEP 3 (DEVELOPMENT OF YELLOW COLOR)

Figure 11:
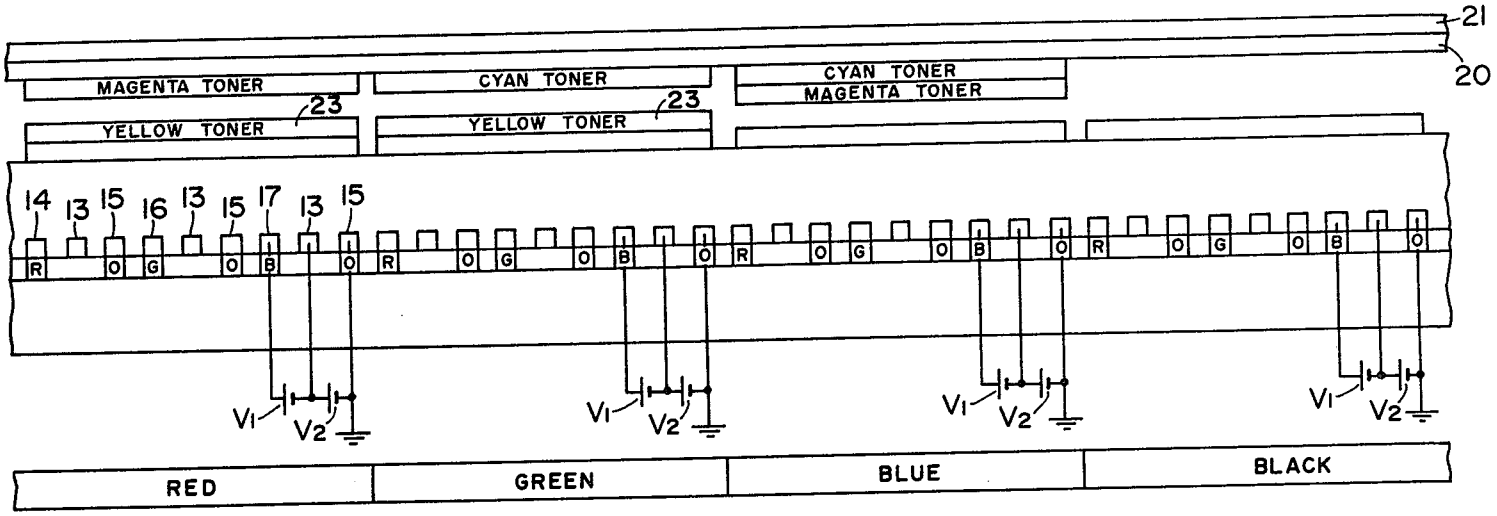

As shown in FIG. 11, the voltages $V_1$ and $V_2$ are applied across the electrodes 13 and 17, and across 13 and 15. The level and polarity of the voltages $V_1$ and $V_2$ may either be the same as, or different from, those in the previous steps. The electrode 15 is earthed. Relationship between the voltages $V_1$ and $V_2$ is assumed to be $V_2=-\frac{1}{2}V_1$, and their levels are set at, for example, $V_1=600$ V and $V_2=-300$ V.

In this case, the potential $V_0$ of the isolated electrically conductive member on the photosensitive member at its portions, where lights from the white and blue portions in the image original have been irradiated, becomes $V_0=$zero volt. On the other hand, the potential $V_0$ corresponding to the portions irradiated by red and green lights from the image original becomes $V_0=-V_1/2$, i.e., $-300$ V. Furthermore, the portion corresponding to the black portion in the image original, where no light has reached, takes its potential of $V_0=$zero volt.

Accordingly, in this state, when the development is effected with the yellow toner of the same polarity as that of the voltage $V_1$, i.e., having a positive polarity charge, the yellow toner 23 adheres only on the isolated electrically conductive member of the photosensitive member where the lights from the red and green portions in the image original have been irradiated. The yellow toner 23 can be transferred onto an image transfer paper by bringing the paper, on which the cyan toner and the magenta toner have been adhered in the Steps 1 and 2, respectively, closer to the photosensitive member in the abovementioned state, and then placing a metal plate on the back surface of the paper, and applying an electric field across the metal plate and the photosensitive member. As the result, there is formed an image on the image transfer paper with the black portion in the image original being excluded.

STEP 4 (DEVELOPMENT OF BLACK COLOR)

Figure 12:
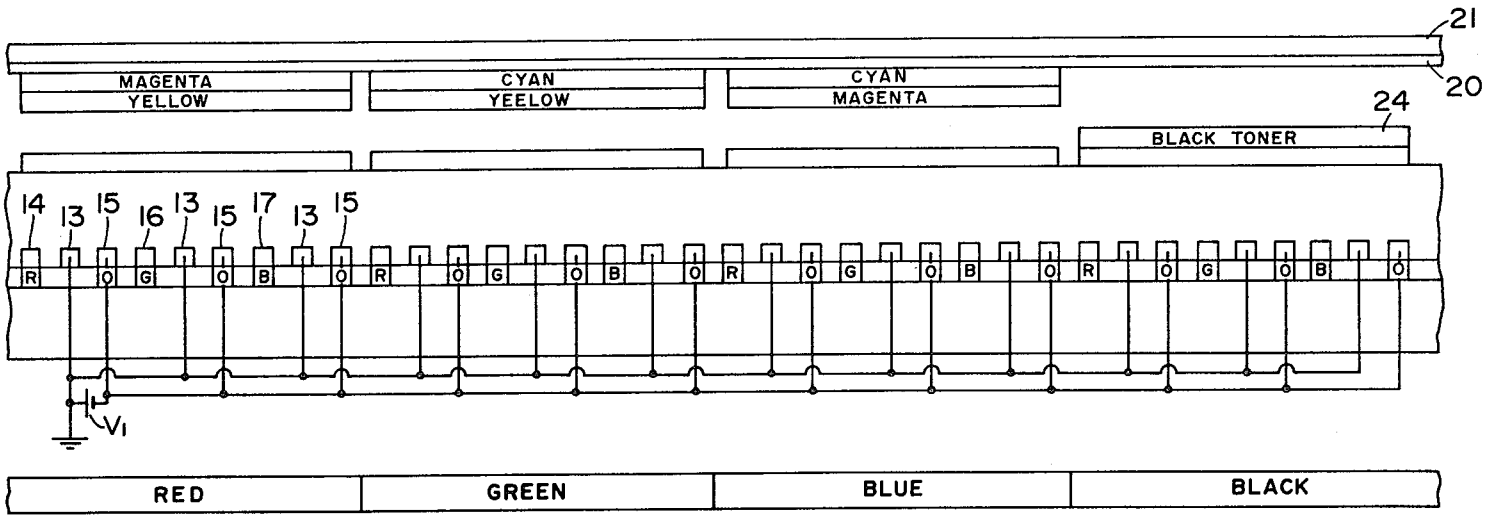

As shown in FIG. 12, the voltage $V_1$ is applied across the electrodes 13 and 15. The direction and level of the voltage $V_1$ are not particularly restrictive, but it is assumed that −600 V is applied to the electrode 15 with the electrode 13 being earthed. The other electrodes are kept in an open state.

In this case, the potential $V_0$ of the isolated electrically conductive member on the photosensitive member at its portions where the lights (white, red, green, and blue) have been irradiated, becomes Vo=zero volt. On the other hand, the potential Vo of the portion corresponding to the black portion in the image original becomes $V_0=-300$ V.

Accordingly, when the development is effected with the black toner of a different polarity from that of the voltage $V_1$, i.e., having a positive polarity, the black toner 24 adheres only on the isolated electrically conductive member of the photosensitive member corresponding to the black portion of the image original.

The black toner 24 can be transferred onto an image transfer paper by placing a metal electrode onto the back surface of the paper, onto which the cyan, magenta, and yellow toners have been adhered through the aforementioned steps 1 through 3, and then bringing the paper with the metal electrode closer to the photosensitive member, and applying an electric field across the metal electrode and the photosensitive member.

Figure 13:
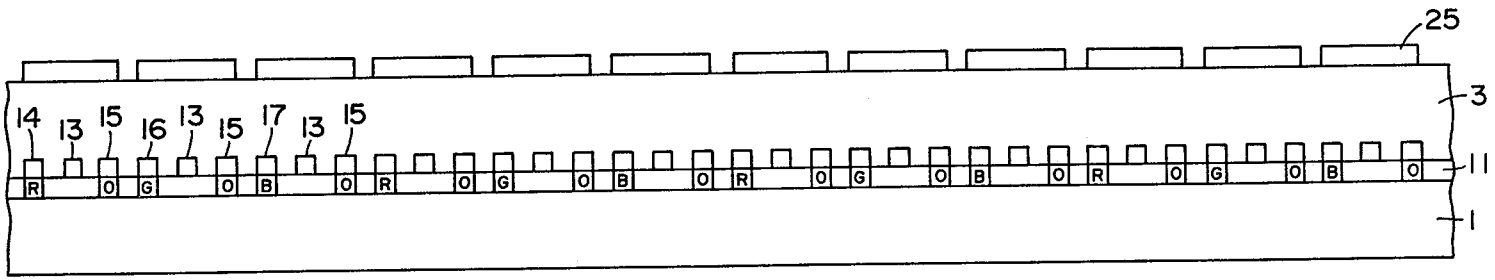
Figure 14:
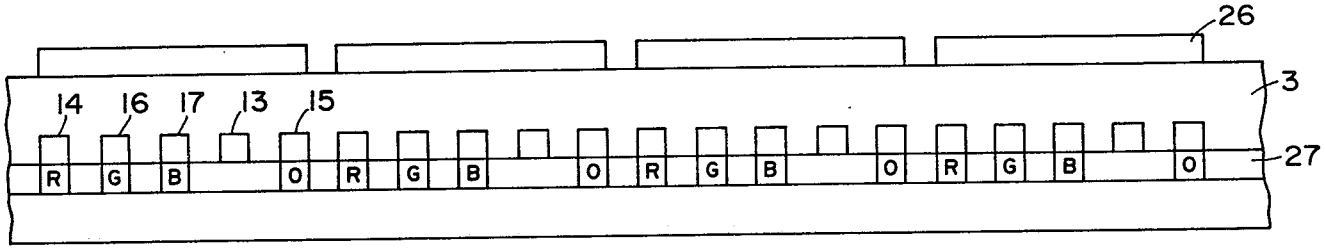

By the foregoing process steps, there may be formed a polychromatic (or multi-colored) image. For the formation of such polychromatic image, there can be used those photosensitive members of the construction other than that shown in FIG. 8. The representative examples of such other photosensitive member are as shown in FIGS. 13 and 14. The photosensitive member of FIG. 13 is of such a construction that the isolated electrically conductive member 25 covers a set of electrodes, i.e., the color filter electrode (red filter electrode 14, green filter electrode 16, or blue filter electrode 17), the transparent electrode 13, and the non-transparent electrode 15. The photosensitive member of FIG. 14 is of such a construction that the transparent electrode 13 is made common to each of the color filter electrodes. A reference numeral 26 designates the isolated electrically conductive member, and a numeral 27 refers to the filter layer. Since the photosensitive member of this construction has fewer transparent electrodes, fabrication of the photosensitive member can be simplified.

It is to be noted here that, in the photosensitive member shown in FIGS. 1, 8, 13, and 14, the isolated electrically conductive member may be in any arbitrary shape such as circle, hexagon, and others, and each of the electrodes is not limited to the comb-shape, but it may take any other form such as a dot-shape, although its fabrication will become rather complicated. As to the color filter electrode, it may be formed without the filter layer as in the embodiment of FIG. 1 by forming the same with an electrically conductive material having the filtering function.

Futhermore, depending on the kind of the color image to be formed, the kind of the color filter electrode for the photosensitive member can be approximately increased or decreased.

EXAMPLE

Gelatin was uniformly applied on a glass plate of 10 cm square to a thickness of approximately 1 micron, into which black and cyan dyes were dissolved by the photo-resist method so as to form color filters of black and cyan, each having a width of 5 microns, in a juxtaposed relationship each other, thereby obtaining the construction shown in FIG. 1. Subsequently, indium oxide ($In_2O_3$) as the transparent electrode material was vapor-deposited over and between the color filters with a width of 5 microns, followed by oxidation at a slow rate in an oxygen atmosphere at a temperature of 50° C., thereby forming the electrode pattern shown in FIG. 2.

Over this electrode pattern, there was formed a photoconductive layer 20 microns thick by vacuum deposition of Se—Te alloy (containing 20% by weight of Te). The substrate during the vacuum deposition process was maintained at a temperature of 60° C. Subsequently, an aluminum electrode as the isolated electrically conductive member shown in FIG. 3 was vacuum deposited to a thickness of approximately 6,000 A to thereby form the photosensitive member for the image formation of the construction as shown in FIG. 1.

In the following, explanations will be given in accordance with the reference numerals in FIG. 1 as to how a polychromatic image can be formed by the use of the photosensitive member according to the present invention.

A voltage of 600 V was applied across the electrodes 6 and 5, and another voltage of −300 V across the electrodes 5 and 7 with the electrode 7 being earthed. At this instant, the potential of the isolated electrically conductive member 4 with no light irradiation thereto was zero volts, it was zero volts with irradiation of the white light, and it was −300 V with irradiation of the red light. The light intensity in this case was 100 lux with the red light, while it was 300 lux with the white light. When the image including black and red colors was exposed in this state, and then the development was effected with the positive (+) red toner, there could be reproduced only the red portion of the image on the isolated electrically conductive member of the photosensitive member. In this case, the development electrode was earthed.

Thereafter, an image transfer paper was placed on the isolated electrically conductive member of the photosensitive member, onto which a metal plate was attached. Then, a voltage of −500 V was applied to the metal plate, and the electrodes 6, 5 and 7 were connected to the earth, thereby transferring the red toner adhered onto the isolated electrically conductive member of the photosensitive member to the image transfer paper.

Next, a voltage of −600 V was applied to the electrode 7 with the electrode 5 being earthed. The electrode 6 was left in an open state. The potential of the isolated electrically conductive member 4 at this instant was −300 V with no irradiation of light, and it showed zero volts with irradiation of the red and white lights.

In this state, when the image which had been used in the above process steps was again exposed, and the development was done with the positive (+) black toner, as a result of which there could be reproduced the image in black alone on the isolated electrically conductive member of the photosensitive member. The developing electrode in this case was grounded.

After this, an image transfer paper was placed on the isolated electrically conductive member of the photosensitive member, onto which a metal plate was positioned. Then, a voltage of −500 V was applied to the metal plate, and the electrodes 6, 5 and 7 were connected to the earth, thereby transferring again the black toner adhered onto the isolated electrically conductive member of the photosensitive member onto the image transfer paper. As a result, there was reproduced on the image transfer paper the image including black and red. Since no color toner adhered onto the black portion, characters in black were very clear even with such extremely simple registration as mentioned above.

What we claim is:

1. An electrophotographic method which comprises the steps of:

(a) simultaneously applying voltages between a transparent electrode and two other electrodes in an electrophotographic photosensitive member comprising a multitude of isolated electrically conductive overlayers for image element formation, a photoconductive layer, a multitude of sets of electrodes, each set of electrodes being composed of a nontransparent electrode layer, a transparent electrode layer, a color filter electrode layer, and a substrate, to effect the color image exposure from the side of the color filter electrode to thereby produce differences between a region corresponding to those color portions in the image original having wavelength regions not transmitting through the color filter electrode but transmitting through the transparent electrode and each of a region corresponding to a white portion in the image original where light transmits through both the transparent electrode and the color filter electrode, a region corresponding to a color portion in the image original having a wavelength region which transmits through the color filter electrodes, and a region corresponding to a black portion in the image original where no light transmits through the transparent electrode and the color filter electrode with respect to the distributed voltages between the transparent electrode and the isolated electrically conductive member, between the color filter electrode and the isolated electrically conductive member, and between the nontransparent electrode and the isolated electrically conductive member; and (b) causing a developing material to be selectively adhered to the isolated electrically conductive member of the region corresponding to those color portions in the image original having wavelength regions not transmitting through the color filter electrode but transmitting through the transparent electrode, by a difference in the electric potential of said isolated electrically conductive member which occurs in correspondence to the difference in the distributed voltages.

2. The electrophotographic method as set forth in claim 1, wherein said developing material has a color of light which is absorbed by the color filter of said color filter electrode.

3. The electrophotographic method as set forth in claim 1, wherein said color filter comprises a cyan color filter electrode, a magenta color filter electrode, and a yellow color filter electrode, and wherein the development is effected by applying a voltage to each of said color filter electrodes.

4. The electrophotographic method as set forth in claim 1, wherein said color filter electrode comprises a red color filter electrode, a green color filter electrode, and a blue color filter electrode, and wherein the development is effected by applying a voltage to each of said color filter electrodes.

5. An electrophotographic method which comprises the steps of:

(a) simultaneously applying voltages between a transparent electrode and two other electrodes in an electrophotographic photosensitive member comprising a multitude of isolated electrically conductive overlayers for image element formation, a photoconductive layer, a multitude of sets of electrodes, each set of electrodes being composed of a nontransparent electrode layer, a transparent electrode layer, a color filter electrode layer, and a substrate, to effect the color image exposure from the side of the color filter electrode to thereby produce differences between a region corresponding to those color portions in the image original having wavelength regions not transmitting through the color filter electrode but transmitting through the transparent electrode and each of a region corresponding to a white portion in the image original where light transmits through both the transparent electrode and the color filter electrode, a region corresponding to a color portion in the image original having a wavelength region which transmits through the color filter electrodes, and a region corresponding to a black portion in the image original where no light transmits through the transparent electrode and the color filter electrode with respect to the distributed voltages between the transparent electrode and the isolated electrically conductive member, between the color filter electrode and the isolated electrically conductive member, and between the nontransparent electrode and the isolated electrically conductive member;

(b) causing a developing material to be selectively adhered to the isolated electrically conductive member of the region corresponding to those color portions in the image original having wavelength regions not transmitting through the color filter electrode but transmitting through the transparent electrode, by a difference in the electric potential of said isolated electrically conductive member which occurs in correspondence to the difference in the distributed voltages;

(c) applying a voltage across at least said non-transparent electrode and said transparent electrode to effect the color image exposure from the side of said color filter electrode to cause a difference to occur between a region corresponding to the black portion in the image original where no light transmits through said transparent electrode and a region other than said region with respect to the distributed voltages between the transparent electrode and the isolated electrically conductive member and between the non-transparent electrode and the isolated electrically conductive member; and (d) causing the developing material to be selectively adhered onto the isolated electrically conductive member by a difference in the potential of said isolated electrically conductive members which occurs in correspondence to the difference in the distributed voltages.

6. An electrophotosensitive member comprising:

(a) a multitude of isolated electrically conductive members for image element formation;

(b) a photoconductive layer; and (c) a multitude of sets of three electrodes for determining an electrical potential of said isolated electrically conductive members in correspondence to a color image original, wherein said photoconductive layer is disposed between said conductive members and said sets of electrodes, and wherein each set of three electrodes is composed of a non-transparent electrode, a transparent electrode, and a color filter electrode.

* * * * *